United States Patent [19]

Priola et al.

[11] Patent Number: 5,074,606

[45] Date of Patent: Dec. 24, 1991

[54] DOOR SECURITY SYSTEM

[76] Inventors: James W. Priola, 6945 Via Mariposa Sur, Bonsall, Calif. 92003; James W. Sauder, 2085 Park Way Dr., Reno, Nev. 89502

[21] Appl. No.: 598,983

[22] Filed: Oct. 17, 1990

Related U.S. Application Data

[63] Continuation of Ser. No. 392,641, Aug. 11, 1989, abandoned, which is a continuation-in-part of Ser. No. 190,245, May 4, 1988, Pat. No. 4,861,082.

[51] Int. Cl.[5] ..... E05B 17/00

[52] U.S. Cl. ..... 292/346; 292/340; 70/418

[58] Field of Search ..... 292/340, 346; 70/418, 70/417, 419, 416

[56] References Cited

U.S. PATENT DOCUMENTS

| | | | |
|---|---|---|---|
| 320,526 | 9/1887 | Biggs . | |
| 1,399,897 | 12/1921 | Singer . | |
| 1,853,456 | 4/1932 | Ross . | |
| 2,144,075 | 1/1939 | Mora . | |
| 2,255,860 | 9/1941 | Riedel . | |
| 3,151,698 | 10/1964 | Pollock . | |
| 3,247,924 | 4/1966 | Price . | |
| 3,271,063 | 9/1966 | Garrett . | |
| 3,405,962 | 10/1968 | Sushan . | |
| 3,592,498 | 7/1971 | Raccuglia . | |
| 3,825,291 | 7/1974 | Sprunger . | |
| 3,888,530 | 6/1975 | Fabrici | 292/340 |
| 3,963,269 | 6/1979 | Rosenberg | 292/340 |
| 4,130,311 | 12/1978 | Sushan | 292/346 |
| 4,178,027 | 12/1979 | Charron | 292/346 |
| 4,189,175 | 2/1980 | Paxton | 292/340 |
| 4,345,787 | 8/1982 | Dabrowski | 292/346 |
| 4,725,084 | 2/1988 | Catricola | 292/346 |

*Primary Examiner*—Eric K. Nicholson

*Attorney, Agent, or Firm*—Jerry R. Seiler

[57] ABSTRACT

An assembly for improving closed door security comprises a door having a unitary first member comprising a first elongated flat plate portion lying substantially entirely in a first plane and a first elongated flat blade portion lying substantially entirely in a second plane, the planes being parallel with the end face of said door, the unitary member secured on the door with the blade portion spanning the latch bolt and extending parallel along the end face substantially entirely between the latch bolt and the outside door edge, a doorjamb having a unitary second member comprising a second elongated flat plate portion and having an opening exposing a latch bolt recess, and lying substantially entirely in a third plane and a second elongated flat blade portion lying substantially entirely in a fourth plane the third and fourth planes being substantially parallel with each other and with the first and said second planes, the second plate and second blade portions having an elongated slot therebetween, and wherein the first flat plate portion, first flat blade portion, second flat plate portion, and second flat blade portion are positioned between the strike face surface and the end face, and the first and second flat blade portions are overlapped, when the door is closed in the doorjamb.

8 Claims, 6 Drawing Sheets

FIGURE 5.
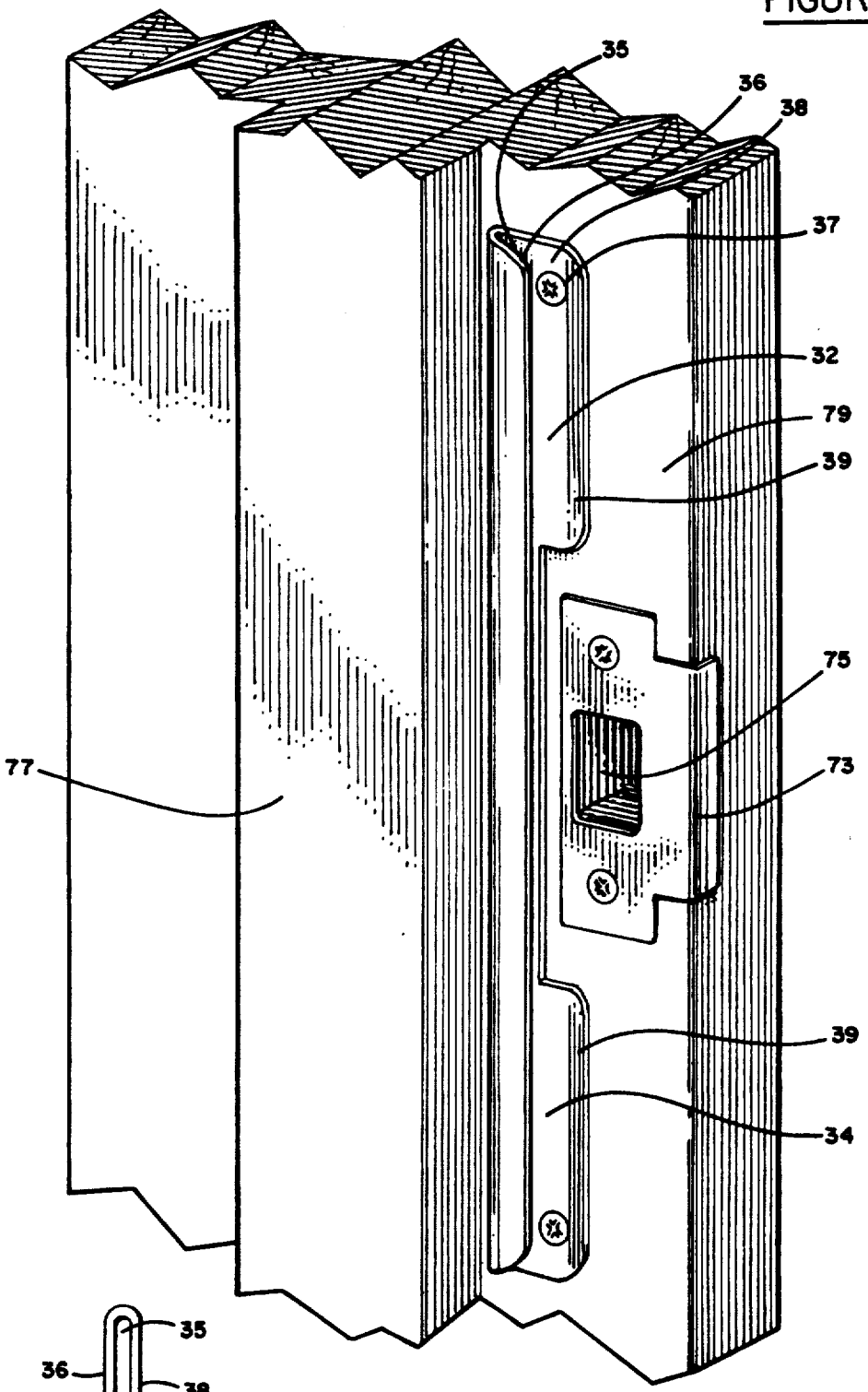
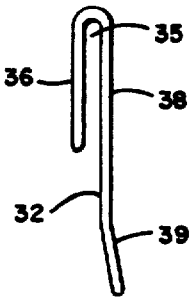
FIGURE 6.

DOOR SECURITY SYSTEM

This application is a continuation of application Ser. No. 07/392641, filed 8/11/89, now abandoned and which is a continuation-in part of copending application Ser. No. 07/190,245 filed May 4, 1988 now U.S. Pat. 4,861,082.

BACKGROUND OF THE INVENTION

The need for door security has increased significantly, especially in high density population areas where condominiums, office buildings, apartments, hotels, etc., are located. Outside doors are especially susceptible to break-in and unauthorized entry where the latch bolt may be exposed between the end face of the door and the doorjamb and may be unlatched with a simple or readily available tool or even a thin, flexible plastic card, or the like to gain entry from the outside, or hallway or corridor. Although a number of systems have been proposed heretofore, including those disclosed in U.S. Pat. Nos. 2,144,075, 1,399,897, 3,606,429, 3,290,081, 3,764,173, 4,180,568, 4,390,199, 4,484,463, and 4,547,009, none have been entirely suitable or widely accepted. It is to an improved door security system which may be easily installed that the present invention is directed.

BRIEF SUMMARY OF THE INVENTION

The improved door security system of the present invention offers advantages over prior art devices in that it can be simply and readily installed without special tools or special training, often requiring only a screwdriver. Moreover, the assembly does not compromise the fire rating or fireproof characteristics or modify the construction of a door or doorjamb. The system may be used on single and double swing doors as well as drawers, and the like. The components of the system of the invention may also be used on doors of any variety such as plastic laminate, composition, hollow construction or metal doors.

The improved door security system of the invention comprises two components, one to be installed on the door end face adjacent the latch assembly face plate and the other component on the doorjamb adjacent the strike plate. Each of the components is a unitary member having an elongated blade which is received in an elongated notch or slot of the other component to cover and protect the latch bolt from exposure outside of the door. The aforesaid advantages as well as the features and components of the system will be apparent from the following detailed description.

BRIEF DESCRIPTION OF THE DRAWINGS

FIG. 5 is a perspective view of the doorjamb component of the assembly of the invention;

FIG. 6 is a top view of the component of FIG. 5;

DETAILED DESCRIPTION OF THE PREFERRED EMBODIMENTS

Figure 1:
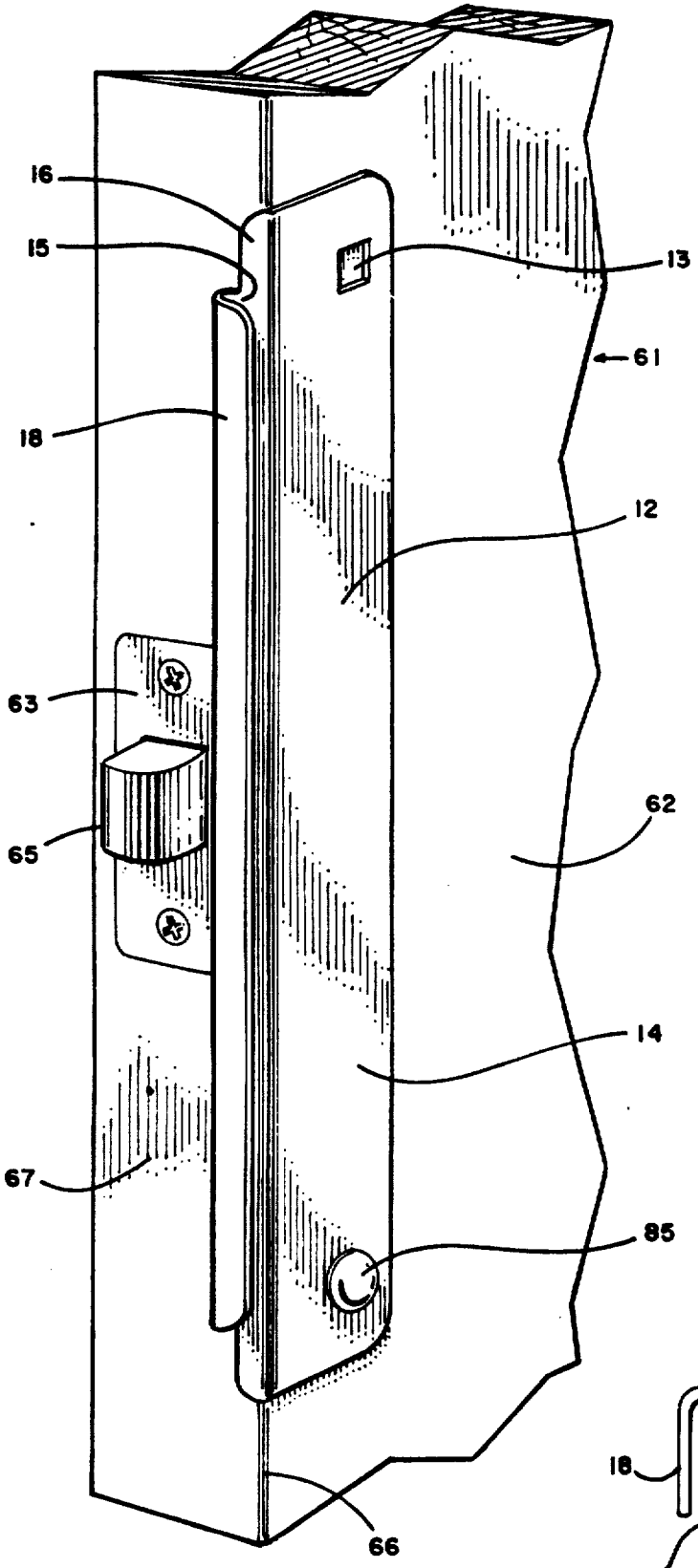
FIGS. 1, 3 and 7 are perspective views of 3 different embodiments of the door component of the assembly of the invention.
Figure 2:
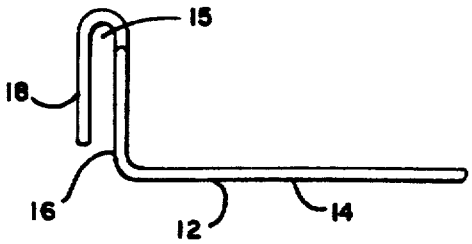
FIGS. 2, 4 and 8 are top views of the aforesaid door component embodiments, respectively.

In FIGS. 1 and 2 there is illustrated a first embodiment of the assembly component for being secured on a door. In this embodiment, the unitary member 12 for being secured on door 61 includes an elongated planar plate portion 16 and an elongated planar blade portion 18 opposite and parallel to plate portion 16. These two planar components are separated by an elongated slot 15 which receives a blade portion of the doorjamb component of the assembly as will be explained hereinafter. In this embodiment, there is also a means for securing the component on the door comprising a pair of holes on a front plate 12 which extends normal to planar plate 16. One hole 13 is shown with the second hole covered by bolt head 85 when the component is installed. Alternative to the front plate for securing the door component, a pair of opposite flat upper and lower tab members extending from the top and bottom, and normal to planar plate portion 16 may be used, each tab member being provided with a hole 13 for securing the component to the door. Such an alternative structure would be the functional equivalent of plate 14 but with a substantial portion of the plate removed. The tab members may be of any suitable dimensions and shape, even a decorative pattern which will be exposed on the outside door surface 62.

Figure 3:
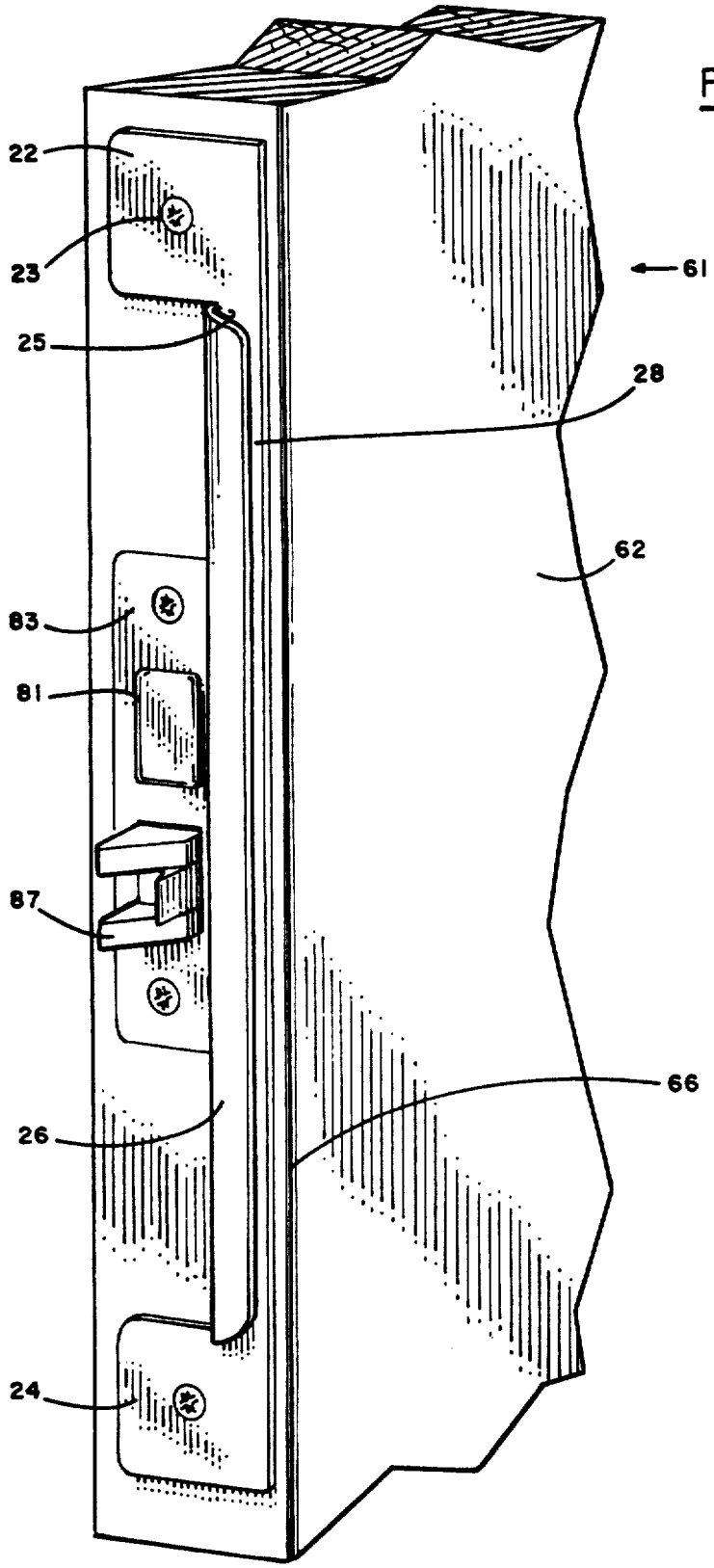

The dimension of elongated planar plate portion 16 and blade portion 18 are important in that they must be long enough to span latch bolt 65 and preferably also latch plate 63 and face plate of a mortise lock as shown in FIG. 3. Thus, the length of the components may be varied to meet different lock and strike plate types. The width of these two portions must also be narrow enough so as not to interfere with latch bolt 65 with the component installed so that the right angle bend between elongated plate portion 16 and front plate portion 14 fits along front edge 66 of door 61. Thus, the elongated planar plate and blade portions 16 and 18 extend back from edge 66 along end face 67 of the door to approximately the forward edge of latch plate 63. For most swinging doors, this width will be between about ⅜ and about ½ inch, with such possible variation depending on the thickness of the door, understanding that latch plate 63 is usually centered in the end face of the door.

Figure 9:
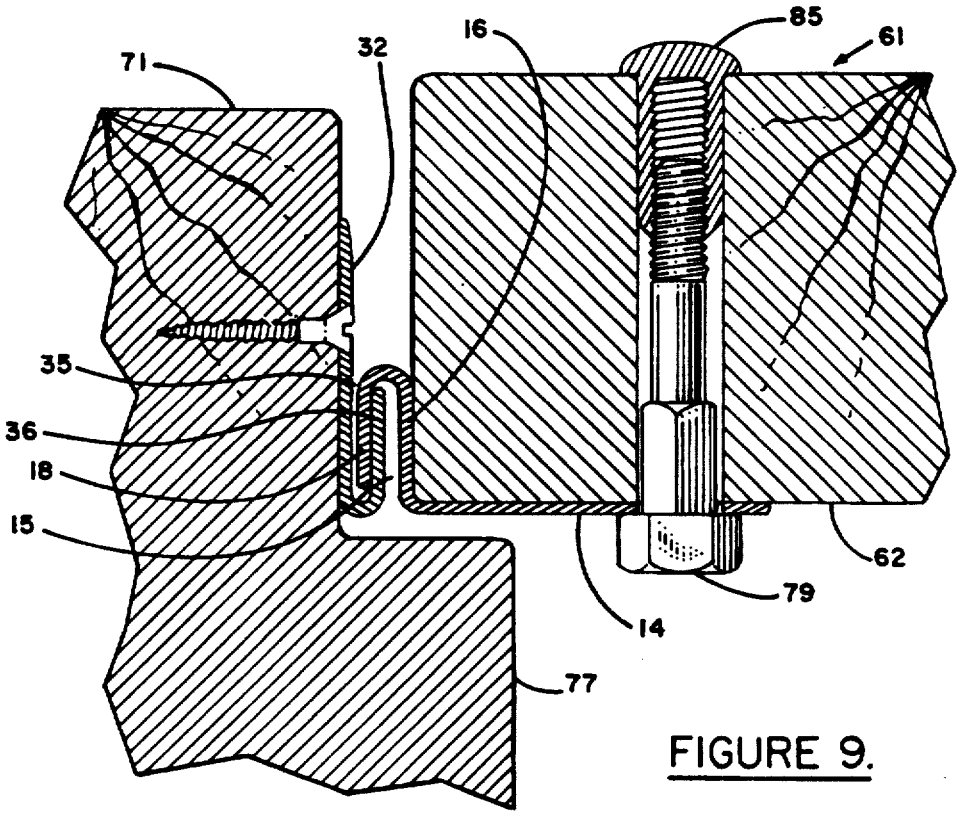
FIG. 9 is a top view, sectioned, of a door and doorjamb with the assembly components of FIGS. 1 and 5 installed thereon.

End plate portion 14 is secured on the outside surface 62 of door 61 with a suitable bolt extending through each of the holes 13 and through the door. Although a screw could be used for securing the plate to the door, it will be understood that such securing means which can be removed from the outside of the door is not suitable for security purposes since one could then easily remove the door component with a screwdriver. Thus, a round bolt head or other anchor device which can not be turned or disengaged from outside of the door is to be used. A preferred anchor comprises a sex bolt and carriage bolt as illustrated in FIG. 9 which will also accommodate most any door thickness.

Figure 4:
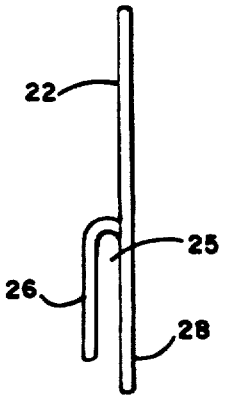

A second door component embodiment is illustrated in FIGS. 3 and 4 again incorporating elongated planar plate and blade portions 28 and 26, respectively. In this embodiment, instead of incorporating a front plate as illustrated in FIGS. 1 and 2, the means for securing the component to end face 67 of door 61 comprises a pair of opposite tab members 22 and 24, respectively, which are simply flat planar extensions of elongated planar plate 28 and which tabs each incorporate a hole 23 through which a screw is inserted for securing the component on the end face of the door. This embodiment is shown spanning latch plate 83 of a mortise lock incorporating a latch bolt 87 and dead bolt 81 and be of a width so as not to interfere with the action of the latch bolt. Thus, width dimension similar to that previously described in the first embodiment may be used although it may also be somewhat smaller, for example down to about ¼ inch since this component does not need to extend out to edge 66 of the door. Like the embodiment of FIGS. 1 and 2, this door component is also unitary, comprising a single piece in which the blade portion 26 is planar and parallel with planar plate portion 28 and separated by an elongated slot 5 for receiving a blade of the doorjamb component. As will be explained further, it is important that the width of slot 25 in this embodiment, as well as slot 15 in the embodiment of FIGS. 1 and 2, be substantially uniform so that it does not bind or interfere with the blade portion of the doorjamb component when the door is opened and closed as will be further explained.

In FIGS. 5 and 6 there is illustrated the doorjamb component of the assembly of the invention comprising an elongated plate portion 38 and an opposite parallel planar blade portion 36 spaced or separated by an elongated slot 35. The planar plate portion 38 includes upper and lower planar extension tabs 32 and 34, each having a hole 37 for securing this component to the doorjamb. The upper and lower wing portions 32 and 34 and the planar plate 38 define an opening for exposing strike plate 73 thereby not interfering with the action of the latch bolt and latch bolt recess 75 in the doorjamb. A preferred device also includes an offset or angled guide face 85 which provides a forward edge or face slightly angled relative to the surface of planar plate 38 to guide the blade of the door component into slot 35. To install the doorjamb component, the inside surface of planar plate 38 is secured against strike face 79 of the doorjamb with the elongated plate 38 aligned axially with stop rail 77. The component can be secured against stop rail 77 or may be moved toward strike plate 73 any desired extent so long as elongated planar plate 38 does not interfere with latch recess 75. The doorjamb component may be used with either a flush mounted or surface mounted strike plate. The component may be also installed using a spacer or shim to compensate for the distance between the door and doorjamb, if necessary. Similarly, shims or spacers may also be used in mounting the door component, but, where such use is desired, it will usually be preferable to use with the doorjamb component.

Alternative to the end tab members 32 and 34 shown, elongated planar plate 38 may extend upwardly and downwardly above and below the upper and lower ends, respectively, of planar blade 36 and such extensions may be provided with holes 37 for securing this component on strike face 79. Such tab members will be similar to tabs 22 and 24 of FIG. 1. Other equivalent configurations and means for securing the doorjamb component may be used, with the understanding that the component is not to interfere with the strike plate or latch bolt recess. Elongated slot 35 which separates planar plate portion 38 and planar blade 36 is also uniform in its dimension between the planar portions like the elongated slots of the door components as previously described. The elongated slot 35 will receive the blade portion of the door component when the door is closed in the doorjamb.

Observing FIG. 9, the relationship of the door and doorjamb components is illustrated with door 61 closed in doorjamb 71. The door and jamb are shown sectioned at different levels to expose the screw and bolt used in the installation. The door component embodiment illustrated in FIGS. 1 and 2 is shown in FIG. 9 with front plate 14 secured in the door using bolts or fasteners extending through the door having a round bolt head 79 exposed on the outer door surface 62. The nesting relationship of the respective blade portions of the door and doorstop components is illustrated. Thus, blade 18 of the door component is received in slot 15 of the doorstop component and blade 36 of the doorstop component is received in slot 15 of the door component when the door is closed. The specific thickness of the flat stock material from which the components are formed is preferably between about 18 and 24 gauge so that counter-sinking in the door or doorjamb surface is not required. Preferably, 20 or 22-gauge thick metal stock is most desirable and will give the necessary strength for the security system while being thin enough not to require special reworking of the door, doorstop, jambs or surfaces to which they are secured. Using such stock, the dimensions across the elongated slots of both the door and doorstop components is such that the blades of the respective components can be received in respective slots without binding or causing friction when the door is being opened and closed.

Figure 7:
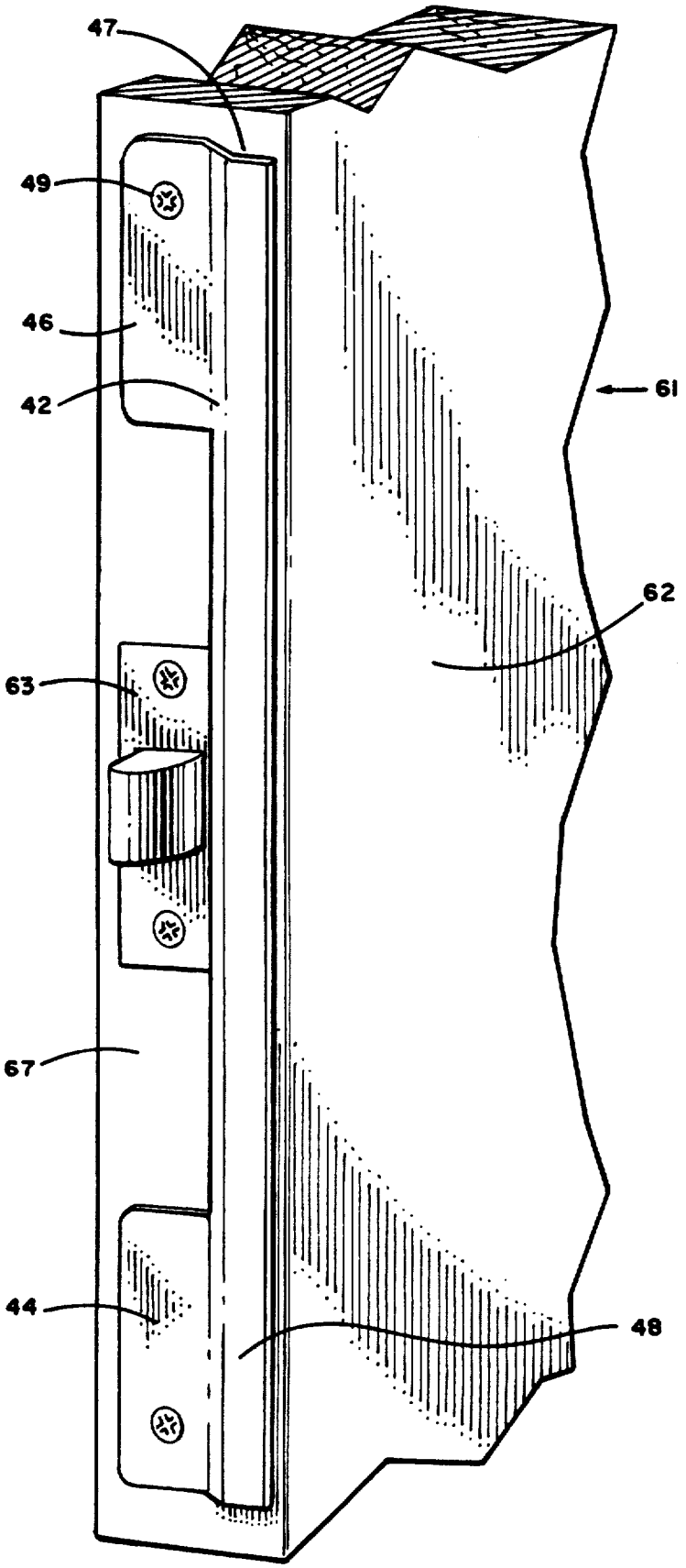
Figure 8:
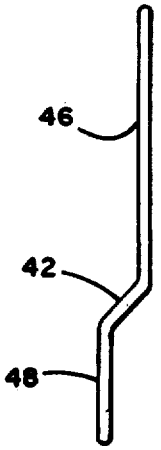

An additional door component embodiment is illustrated in FIGS. 7 and 8 incorporating an elongated blade 48 which extends from end planar tab members 44 and 46 which each provide with a hole 49 for securing the component to the end face 67 of a door. In this embodiment, an elongated strip portion extends at an angle between the parallel planar end portions 44 and 46 and blade portion 48. FIG. 8 also illustrates this strip portion 42 which extends at an angle of about 90° or less and preferably an acute angle of between about 20 and about 80° from each of the planar components. Again, it will be observed that the planar components 46 and 48 are parallel.

Figure 10:
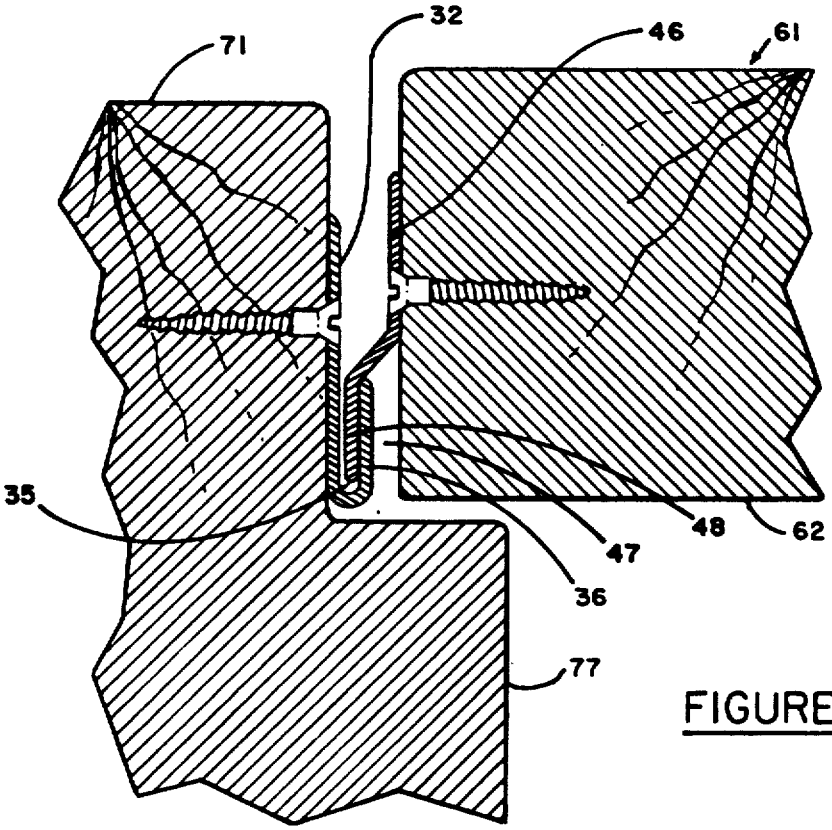
FIG. 10 is a view similar to FIG. 7 with the assembly components of FIGS. 5 and 7.

Also observing FIG. 10, with the door component of this embodiment installed on the end face of a door, blade 48 is spaced from the door end face leaving a elongated slot 47 into which blade 36 extends when the door is closed as illustrated. Blade 48 also extends into elongated slot 35 of the doorstop component 32.

Figure 11:
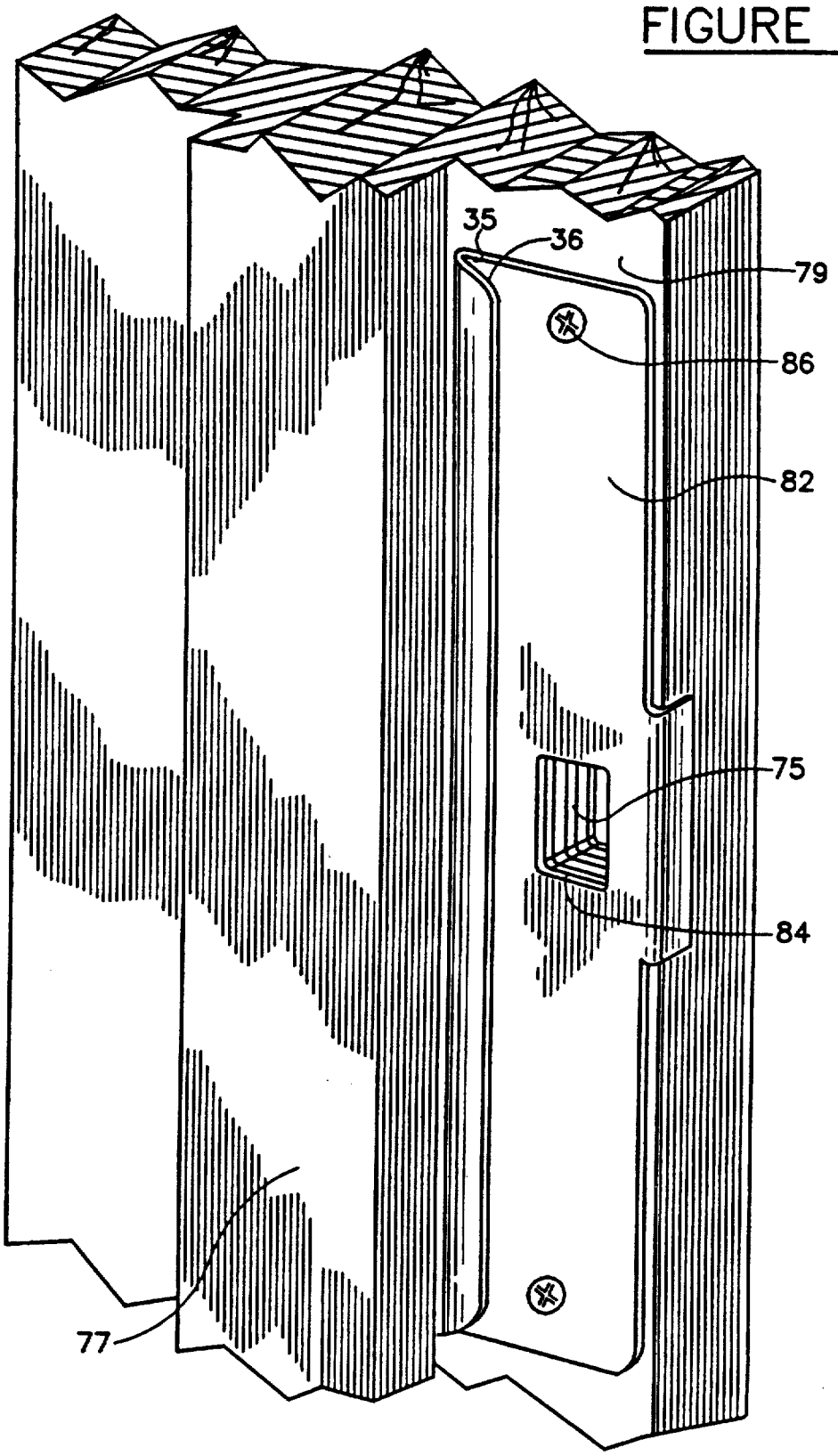
FIG. 11 is a perspective view showing another doorjamb component embodiment according to the invention.

In FIG. 11, there is illustrated a second embodiment of a doorjamb component. This embodiment, alternative to that illustrated in FIG. 5, combines the doorjamb component with the strikeplate to form a single, unitary component. In the embodiment of FIG. 5, the doorjamb component comprises a single planar plate portion 82 having latch bolt opening 84 for exposing the latch bolt recess 75 form in the doorjamb. A planar blade portion 36 extends along one side of planar plate 82, and is co-planar with the plate which portions are separated by a elongated slot 35, substantially as shown in FIG. 6 regarding the FIG. 5 embodiment. The doorjamb component is installed against strike face 79 and aligned axially adjacent stop row 77 as illustrated. Screws 86 are used conveniently for installing the plate against the strike face 79. In the case of a wood doorjamb, if it is desired to mount the plate portion of the component flush with the strike face surface, the strike face may be chiseled or routed. With the doorjamb component embodiment of FIG. 11 installed, and the door component of the type illustrated in FIGS. 1–4 or FIGS. 7 and 8 installed in the door, the respective components will fit in the manner illustrated in FIGS. 9 and 10, and as previously described.

The various components of FIGS. 2, 4, 6, 8, 9 and 10 are shown approximately twice the actual dimensions of preferred components. Thus, the relationships of installed components and features in their nested relationship with the door closed are particularly apparent in FIGS. 9 and 10.

It will be evident that the door and doorstop components of the invention may be easily surface installed, often without special tools, and without routing, notching, cutting, chiseling, or otherwise modifying or reworking door or doorstop surfaces or even countersinking the components. If necessary, either component may be installed with a shim or spacer to accommodate a relatively wide door to jamb space. Because of the unique features of the components, when installed as illustrated in FIGS. 9 and 10, when the doors is closed, access to the latch bolt from outside the door along the seam between the door and doorjamb is not possible. Thus, even if the stop rail is removed from the doorjamb exposing the seam between the door and doorjamb, the latch bolt is protected by the security assembly of the invention. These same components may be used on double inswinging doors as well as desk drawers or any other mating surfaces to be opened and closed relative to one another in which security is desired against the doors or drawers being pried or otherwise forces for unauthorized entry. When used on such double doors, the astragal need not be removed or modified. Moreover, the components may be installed on doors and frames of most any thickness and materials. The doorjamb component also acts to reinforce the frame adjacent the strike plate. These as well as other embodiments within the purview of the invention and advantages thereof will be evident to those skilled in the art.

We claim:

1. In combination, an assembly comprising a doorjamb having a substantially flat planar strike face surface extending between a front and a back edge and having a latch bolt recess therealong, and a door having a substantially flat planar end face extending between an inside and an outside door edge, and a latch bolt exposed on said end face, said door secured in opening and closing relationship with said doorjamb, said door having a unitary first member comprising a first elongated flat plate portion having an upper end and a lower end and lying substantially entirely in a first plane, parallel with the plane of said planar end face of said door, and abutting said flat planar end face of said door substantially entirely along its length between said upper end and said lower end, and a first elongated flat blade portion lying substantially entirely in a second plane substantially parallel with said first plane and said flat planar end face of said door and coextending substantially along its length in said second plane with said first plate portion, said first and said second planes being parallel with said end face of said door, said unitary member secured on said door with said blade portion spanning said latch bolt and extending parallel along said end face substantially entirely between said latch bolt and said outside door edge, said doorjamb having a unitary second member comprising a second elongated flat plate portion forming a strikeplate having an opening therein, said opening exposing said latch bolt recess therethrough, said second elongated flat plate portion having an upper end and a lower end and lying substantially entirely in a third plane substantially parallel with the planar strike face surface and a second elongated flat blade portion lying substantially entirely in a fourth plane, said third and said fourth plane being substantially parallel with each other and with said first and said second planes, said second plate and second blade portions having an elongated slot therebetween, said unitary second member secured on and abutting said strike face surface substantially entirely along its length between said upper and said lower end, and said second flat blade portion spanning said strike plate and extending substantially entirely between said back edge and said latch bolt recess, and wherein said first flat plate portion, first flat blade portion, second flat plate portion, and second flat blade portion are positioned between said strike face surface and said end face, and said first and second flat blade portions are overlapped, when said door is closed in said doorjamb.

2. The assembly of claim 1 wherein said first flat plate portion comprises a first pair of opposite planar end portions secured above and below said latch bolt, respectively, on said end face of said door.

3. The assembly of claim 2 wherein said first member includes a first elongated flat strip portion extending at an acute angle between and secured to each of said end portions and to said first blade portion.

4. The assembly of claim 3 wherein said first strip portion lies substantially along a fifth plane which extends from said first plane at an acute angle of between about 20° and about 80°.

5. The assembly of claim 1 wherein said first plate portion and said first blade portion have an elongated slot extending therebetween.

6. The assembly of claim 5 wherein said first member includes a flat planar side plate portion integral with and extending along the length of said first plate portion and substantially normal thereto.

7. The assembly of claim 1 wherein said first plate portion includes means for securing said first member on said door.

8. The assembly of claim 6 wherein said side plate portion includes means for securing said first member on said door.

* * * * *